US008521041B2

(12) United States Patent
Kojima et al.

(10) Patent No.: US 8,521,041 B2
(45) Date of Patent: Aug. 27, 2013

(54) IMAGE FORMING APPARATUS WITH CONTROLLER CONTROLLING AN IMAGE FORMING OPERATION

(75) Inventors: Katsuhiro Kojima, Mishima (JP); Kenji Matsuda, Numazu (JP); Masaki Ojima, Mishima (JP); Minoru Matsuguma, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 132 days.

(21) Appl. No.: 13/014,873

(22) Filed: Jan. 27, 2011

(65) Prior Publication Data

US 2011/0200340 A1 Aug. 18, 2011

(30) Foreign Application Priority Data

Feb. 12, 2010 (JP) ..... 2010-029126

(51) Int. Cl.
*G03G 15/00* (2006.01)
*G03G 15/01* (2006.01)
*G03G 15/08* (2006.01)

(52) U.S. Cl.
USPC ..... 399/12; 399/27; 399/28; 399/29; 399/44; 399/54

(58) Field of Classification Search
USPC ..... 399/12, 24
See application file for complete search history.

(56) References Cited

U.S. PATENT DOCUMENTS 5,528,341 A 6/1996 Shishido et al.
5,642,187 A 6/1997 Nomura et al.
5,650,841 A 7/1997 Matsuda et al.
5,678,139 A 10/1997 Nomura et al.
5,697,022 A 12/1997 Matsuda et al.
5,765,077 A 6/1998 Sakurai et al.
5,825,472 A 10/1998 Araki et al.
5,867,751 A 2/1999 Nomura et al.
6,016,408 A 1/2000 Hashimoto et al.
6,101,352 A 8/2000 Hashimoto et al.
6,151,459 A 11/2000 Hashimoto et al.
6,188,852 B1 2/2001 Ojima et al.

(Continued)

FOREIGN PATENT DOCUMENTS

JP 2002351190 12/2002
JP 2005257799 9/2005

OTHER PUBLICATIONS

Office Action in Chinese Patent Application No. 201110036426.9, dated Apr. 15, 2013 (with English translation).

*Primary Examiner* — Walter L Lindsay, Jr.
*Assistant Examiner* — David Bolduc
(74) *Attorney, Agent, or Firm* — Fitzpatrick, Cella, Harper & Scinto

(57) ABSTRACT

An image forming apparatus includes an image bearing member; a plurality of developing cartridges including respective toner accommodating portions for accommodating toners for forming an image on the image bearing member; a discriminating portion for discriminating color of the toner accommodated in each of the plurality of developing cartridges; a controller capable of controlling an image forming operation in a state in which the developing cartridges, of the plurality of developing cartridges, accommodating the toners of the same color are mounted; and a storing portion for storing lifetime information of the plurality of developing cartridges, respectively. When the developing cartridges accommodating the toners of the same color are mounted, the controller determines the developing cartridge, of the developing cartridges accommodating the toners of the same color, to be used for performing the image forming operation, on the basis of the lifetime information.

13 Claims, 10 Drawing Sheets

(56) References Cited

U.S. PATENT DOCUMENTS

| | | | | |
|---|---|---|---|---|
| 6,272,300 | B1 | 8/2001 | Fujiwara et al. | |
| 6,324,370 | B1 | 11/2001 | Isobe et al. | |
| 6,427,054 | B1 | 7/2002 | Ohkubo et al. | |
| 6,549,733 | B2 | 4/2003 | Matsuguma | |
| 6,564,029 | B2 | 5/2003 | Kojima et al. | |
| 6,577,823 | B2 | 6/2003 | Matsuguma et al. | |
| 6,654,568 | B2 | 11/2003 | Matsuguma | |
| 6,668,141 | B2 | 12/2003 | Kojima et al. | |
| 6,704,524 | B2 | 3/2004 | Matsuguma et al. | |
| 6,741,824 | B2 | 5/2004 | Ojima et al. | |
| 6,873,815 | B2 | 3/2005 | Matsuda et al. | |
| 6,892,035 | B2 | 5/2005 | Matsumoto et al. | |
| 6,922,539 | B2 | 7/2005 | Uyama et al. | |
| 6,961,527 | B2 | 11/2005 | Matsuguma et al. | |
| 6,968,147 | B2 | 11/2005 | Matsuda et al. | |
| 6,980,755 | B2 | 12/2005 | Numagami et al. | |
| 7,113,711 | B2 * | 9/2006 | Okamura | 399/27 |
| 7,130,550 | B2 * | 10/2006 | Mochizuki | 399/45 |
| 7,130,559 | B2 * | 10/2006 | Kimura et al. | 399/109 |
| 7,200,350 | B2 | 4/2007 | Agata et al. | |
| 7,277,659 | B2 | 10/2007 | Kobayashi et al. | |
| 7,454,160 | B2 | 11/2008 | Ojima et al. | |
| 7,593,670 | B2 | 9/2009 | Matsuda et al. | |
| 7,813,670 | B2 | 10/2010 | Matsuda | |
| 2005/0019061 | A1 * | 1/2005 | Karakama et al. | 399/111 |
| 2005/0123308 | A1 * | 6/2005 | Taguchi | 399/12 |
| 2005/0201764 | A1 | 9/2005 | Okamoto et al. | |
| 2006/0067719 | A1 * | 3/2006 | Karasawa | 399/44 |
| 2006/0083532 | A1 * | 4/2006 | Esterman et al. | 399/82 |
| 2006/0110176 | A1 * | 5/2006 | Sekiguchi et al. | 399/53 |
| 2006/0120737 | A1 * | 6/2006 | Takahashi | 399/27 |
| 2006/0216050 | A1 * | 9/2006 | Taguchi | 399/53 |
| 2007/0037082 | A1 * | 2/2007 | Goto et al. | 430/108.1 |
| 2007/0166078 | A1 * | 7/2007 | Kozuma | 399/227 |
| 2007/0201897 | A1 * | 8/2007 | Maeda et al. | 399/101 |
| 2008/0145073 | A1 * | 6/2008 | Lane et al. | 399/44 |
| 2008/0159770 | A1 * | 7/2008 | Ohmura et al. | 399/82 |
| 2010/0014893 | A1 * | 1/2010 | Lange | 399/223 |
| 2010/0080624 | A1 | 4/2010 | Matsuda | |
| 2010/0322664 | A1 | 12/2010 | Matsuda | |

* cited by examiner

IMAGE FORMING APPARATUS WITH CONTROLLER CONTROLLING AN IMAGE FORMING OPERATION

FIELD OF THE INVENTION AND RELATED ART

The present invention relates to an image forming apparatus to which a plurality of developing cartridges accommodating developers (toners) of the same color are mountable.

An image forming apparatus of an electrophotographic recording type in which an electrostatic latent image is formed on a surface of a photosensitive member has been conventionally known. In this image forming apparatus, the electrostatic latent image is developed with toner into a toner image and then the toner image carried on the photosensitive member surface is transferred onto a recording material (medium) such as a recording sheet to effect image formation. The electrostatic latent image is developed with the toner by rotating a developing roller which opposes the photosensitive member surface and by depositing the toner, present at the surface of the developing roller, on the photosensitive member surface.

As the image forming apparatus of the electrophotographic recording type, there is an image forming apparatus constituted so that a plurality of developing cartridges each including a toner accommodating container together with a supplying roller and the developing roller which opposes the photosensitive member surface can be accommodated in a rotary unit. In this image forming apparatus, the rotary unit is rotated about a rotation shaft (axis) thereof, so that the developing cartridge located at a developing position in which the developing cartridge opposes the photosensitive member can be switched.

For this reason, such an image forming apparatus is constituted so that the developing cartridges which accommodate yellow (Y) toner, magenta (M) toner, cyan (C) toner and black (B) toner, respectively are mountable as the developing cartridge for depositing the toner on the photosensitive member surface. As a result, the developing cartridges are successively switched, so that a color image of superposed component images of the respective colors can be formed.

Further, to the image forming apparatus, a plurality of developing cartridges which accommodate toner of the same color (e.g. black) are constituted so as to be mountable, so that formation of a single color (monochromatic) image can be continued for a long term. Japanese Laid-Open Application (JP-A) 2002-351190 describes such a constitution.

As the image forming apparatus to which the plurality of developing cartridges of the same color (black) are mountable, in the case where the toner is used in a predetermined amount in order to perform a toner supplying operation, there is an image forming apparatus in which the rotary unit is required to be rotated. In order to reduce a developing cartridge switching operation for performing the toner supplying operation, an adjacent developing cartridge may only be required to be placed in a usable state for a long term. For that purpose, some developing cartridges are preferentially used from the developing cartridge having a longest remaining lifetime to average the lifetimes of the developing cartridges and thus a period until any developing cartridge runs out of the toner is increased as long as possible, so that the switching operation from the developing cartridge to the adjacent developing cartridge can be continued for a long term. Such a constitution is described in JP-A 2005-257799.

As in the conventional image forming apparatuses, when a method of selecting the developing cartridge used for image formation from the developing cartridges for the same color which are mounted to the image forming apparatus was fixed to one method, various inconveniences were caused and there arose a problem that the image forming apparatus was unable to meet a variety of user needs.

Specifically, in the image forming apparatuses described in JP-A 2002-351190 and JP-A 2005-257799, due to a difference in operation (use) history of the developing cartridges, a problem such that a difference in quality of a print image was caused. The developing cartridge with a high frequency of printing an image of a low print ratio provides a large number of sheets subjected to printing until the end of its lifetime (no toner). On the other hand, the developing cartridge with a high frequency of printing an image of a high print ratio provides a small number of sheets subjected to printing until the end of its lifetime (no toner). When the printing operation is performed, friction among the toner, the developing roller, a toner (thickness)-regulating member and the supplying roller occurs and as a result, an external additive deposited on the toner surface is buried in the toner surface or is decreased by liberation or the like. For that reason, as the print number for the developing cartridge is larger, a degree of lowering in image quality due to a decrease in amount of the external additive at the toner surface is larger. For this reason, with respect to the developing cartridge which was subjected to printing of an image of an extremely low print ratio on a large number of sheets, there arose a problem that the image quality was remarkably lowered in the neighborhood of the end of the lifetime (no toner) of the developing cartridge.

Further, during determination of the developing cartridge used as described in JP-A 2005-257799, when the developing cartridge with a longest remaining lifetime was selected and used, the toners of all of the developing cartridges ran out at the substantially same time in some cases. In these cases, there arose problems that a developing cartridge exchanging operation by a user was concentrated in a short period and that the user was required to prepare a stock of four developing cartridges, and the like problem.

SUMMARY OF THE INVENTION

A principal object of the present invention to obviate the in conveniences as described above in an electrophotographic image forming apparatus to which a plurality of developing cartridges which accommodate developers (toners) of the same color.

According to an aspect of the present invention, there is provided an image forming apparatus comprising:

an image bearing member;

a plurality of developing cartridges including respective toner accommodating portions for accommodating toners for forming an image on the image bearing member;

a discriminating portion for discriminating color of the toner accommodated in each of the plurality of developing cartridges;

a controller capable of controlling an image forming operation in a state in which the developing cartridges, of the plurality of developing cartridges, accommodating the toners of the same color are mounted; and a storing portion for storing lifetime information of the plurality of developing cartridges, respectively, wherein when the developing cartridges accommodating the toners of the same color are mounted, the controller determines the developing cartridge, of the developing cartridges accommodating the toners of the same color, to be used for performing the image forming operation, on the basis of the lifetime information.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, the image forming apparatus according to the present invention will be described more specifically with reference to the drawings.

Embodiment 1

Figure 1:
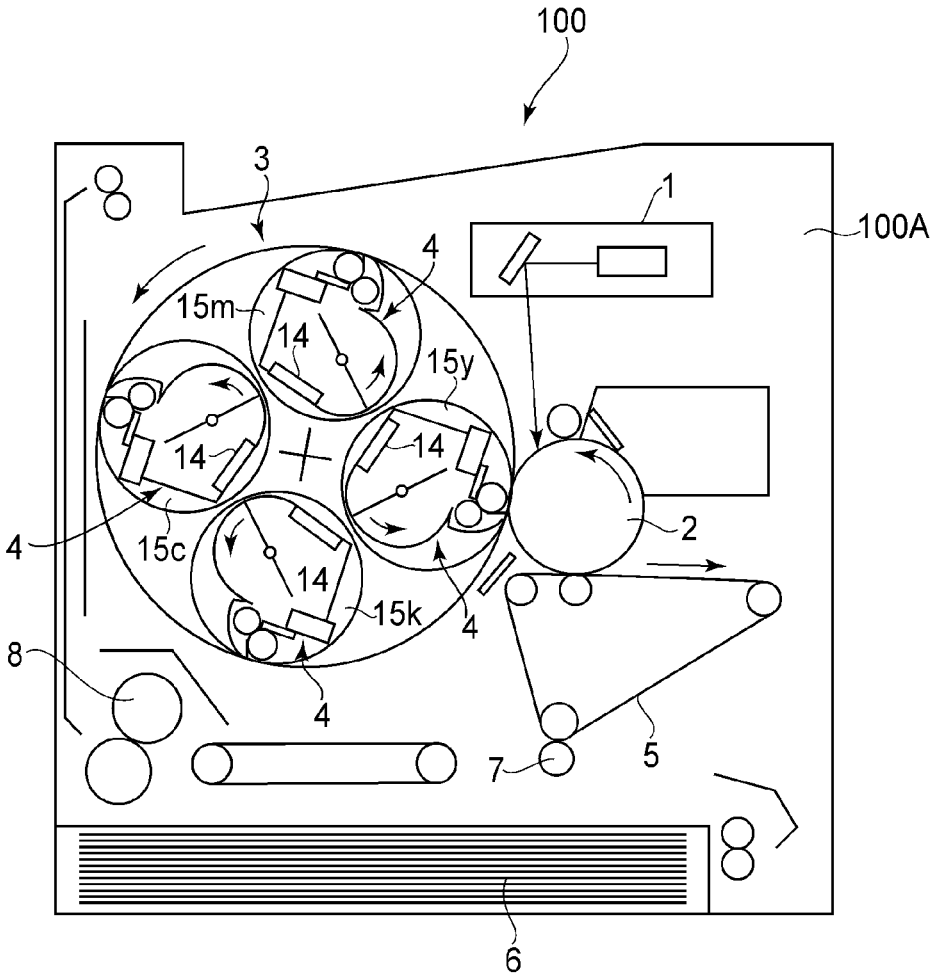
FIG. 1 is a schematic illustration of a laser beam printer of an electrophotographic type as an embodiment of the image forming apparatus according to the present invention.
Figure 3:
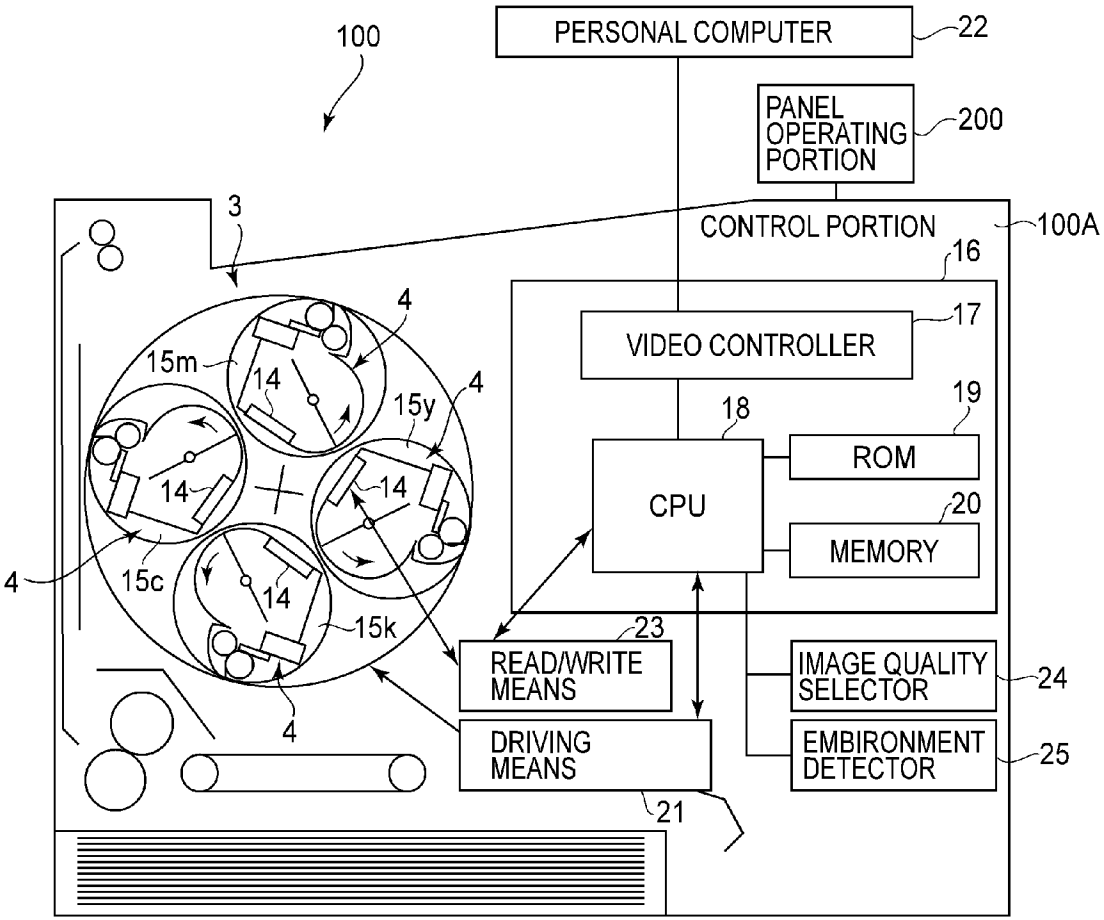
FIG. 3 is a control block diagram of the image forming apparatus.

Referring to FIG. 1, an apparatus main assembly 100A of an image forming apparatus 100 which is a laser beam printer in this embodiment is connected with a personal computer 22 through a video controller 17 in a main assembly controller 16 as shown in FIG. 3. Further, image data sent from an external terminal is received by the video controller 17 and then is converted into a video signal consisting of a dot image, so that image formation is started.

As shown in FIG. 1, a surface of a drum-like electrophotographic photosensitive member 2 as an image bearing member (hereinafter referred to as a "photosensitive drum") is selectively irradiated with laser light on the basis of the inputted image data by a laser light scanning device 1 to be subjected to scanning exposure. As a result, the image forming apparatus 100 forms an electrostatic latent image based on the image data on the surface of the photosensitive drum 2. The image forming apparatus 100 includes a developing rotary unit 3 as a developing device (developing means). The developing rotary unit 3 includes accommodating spaces 15*y*, 15*m*, 15*c* and 15*k* which accommodate developing units for developing the electrostatic latent image on the photosensitive drum 2 with toners of yellow (Y), magenta (M), cyan (C) and black (K), i.e., accommodate developing cartridges 4. The developing cartridge 4 for the color corresponding to the image data for forming the electrostatic latent image is opposed to the photosensitive drum 2 and then the accommodated toner is deposited on the photosensitive drum 2, so that the electrostatic latent image is develop with the toner.

Incidentally, the image forming apparatus calculates a remaining toner amount by a method, as a remaining toner amount determining method of each of the developing cartridges 4, in which an amount of consumption of the developer is calculated from an integrated value of laser light emission time from initial use (integrated pixel count).

In this embodiment, with respect to the developing rotary unit 3, the developing cartridges 4 for black can be accommodated in each of the accommodating spaces 15*y*, 15*m*, 15*c* and 15*k*. In this case, the image forming apparatus can also be utilized as a dedicated machine for forming a single color image (monochromatic image). Further, in this case, a plurality of the developing cartridges 4 for black are mounted and therefore compared with the case where only one developing cartridge 4 for black is mounted, single color image formation of black can be effected for a long term.

The image forming apparatus in this embodiment is of an intermediary transfer type using an intermediary transfer member and uses an intermediary transfer belt 5 as the intermediary transfer member. The intermediary transfer belt 5 superposedly receives toner images of the toners of yellow (Y), magenta (M), cyan (C) and black (K) successively (the order is not limited to this order) from the surface of the photosensitive drum 2 and forms and holds the toner images on the belt surface. A secondary transfer roller 7 as a secondary transfer means nip-conveys a recording sheet 6, fed between itself and the intermediary transfer belt 5, by press-contacting the recording sheet 6 so as to nip the recording sheet 6 black itself and the intermediary transfer belt 5, so that the toner images are transferred onto the recording sheet 6. That is, in this embodiment, the intermediary transfer type in which the transfer of the toner images onto the recording sheet 6 is effected by the medium of the intermediary transfer belt 5 is employed.

A fixing roller 8 as a fixing means heats and press-contacts the conveyed recording sheet 6 to fix the toner images and nip-conveys the recording sheet 6 toward a further downstream side. As a result, a monochromatic image or color image on the basis of the received image data is recorded and formed (fixed) on one side or on both sides of the recording sheet 6. The image can be continuously recorded and formed on a plurality of sheets by repeating such an operation.

Figure 2:
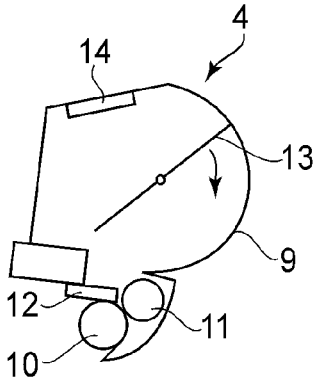
FIG. 2 is a schematic illustration of an example of a developing cartridge used in the image forming apparatus.

Next, with reference to FIG. 2, the developing cartridge 4 in this embodiment will be described. The developing cartridge 4 includes a toner accommodating portion (developer accommodating portion) 9 accommodating the developer (toner), a developing roller (developer carrying member) 10, a supplying roller (developer supplying member) 11, a toner (thickness) regulating member 12 and a toner stirring member 13. The toner is fed to a position in the neighborhood of the supplying roller 11 by rotation of the toner stirring member 13 in a direction indicated by an arrow. The supplying roller 11 supplies the toner to the developing roller 10. The toner supplied on the developing roller 10 by the supplying roller 11 is uniformized (in thickness) by the toner regulating layer to form a toner layer and then the electrostatic latent image on the photosensitive drum 2 is developed with the toner.

The developing cartridge 4 includes a random access memory (readable and writable memory) 14 as a storing means (storing portion). The memory 14 is disposed opposed to a reading/writing means 23 of the image forming apparatus only when the developing cartridge 4 mounted in the developing rotary unit 3 is moved to a position in which the developing cartridge 4 opposes the photosensitive drum 2. As a result, information is readable from and writable in the memory 14.

In the memory 14 of each developing cartridge 4, use (operation) history information is stored. Examples of the use history information may include color information of the developer (toner), a remaining developer amount, the number of pixels from initial use at a printing portion (integrated pixel count), the number of all of pixels from initial use (at the printing portion and at a non-printing portion), an average print ratio, a print number, the number of rotations (rotation number) (driving time) of the developing roller, and the like. During the image forming operation or after the image formation, the use history information in the memory 14 and in a main assembly memory is updated. The average print ratio as the use history information is data calculated by diving the integrated pixel count of the formed image from the initial use of the developing cartridge by the number of all of pixels from the initial use. The average print ratio can also be calculated from the print number and the integrated pixel count of the formed image from the initial use of the developing cartridge.

A CPU 18 of a main assembly controller (control means) 16 performs various control operations shown in FIG. 3 in accordance with a control program in ROM 19 after electric power is turned on. That is, during the turning-on of the electric power or during exchange of the developing cartridge 4, the developing rotary unit 3 is rotationally driven to cause all of the memories 14 of the developing cartridges 4 mounted in the developing rotary unit 3 to oppose the reading/writing means 23 of the image forming apparatus main assembly 100A, thus establishing communication between the means 23 and each of the memories 14. That is, the reading/writing means 23 functions as a developing cartridge discriminating means (discriminating portion). Then, pieces of information such as the presence or absence of the developing cartridges set in the accommodating spaces 15*y*, 15*m*, 15*c* and 15*k* of the developing rotary unit 3, the color information of the toner, the remaining developer amount and the average print ratio are held (stored) in the main assembly memory 20. The CPU 18 checks the presence or absence of the developing cartridges set in the accommodating spaces 15*y*, 15*m*, 15*c* and 15*k* of the developing rotary unit 3, the color information, the remaining developer amount and the like and then executes control of various image forming operations.

The color information of each of the developing cartridges 4 mounted in the accommodating spaces 15*y*, 15*m*, 15*c* and 15*k* of the developing rotary unit 3 is written in "Y", "M", "C" or "K" in the main assembly memory 20 during the turning-on of the power or during the exchange of the developing cartridge 4.

The writing operation of the color information "Y" of the accommodating space 15*y* will be described. In the case where the developing cartridge 4 is not accommodated in the accommodating space 15*y*, "Y=0" is written in the main assembly memory 20 as discriminating information. In the case where the developing cartridge 4 for black is accommodated, "Y=1" is written in the main assembly memory 20. In the case where the developing cartridge 4 for yellow is accommodated, "Y=2" is written in the main assembly memory 20. In the case where the developing cartridge 4 for magenta (M) is accommodated, "Y=3" is written in the main assembly memory 20. In the case where the developing cartridge 4 for cyan (C) is accommodated, "Y=4" is written in the main assembly memory 20.

Here, in this embodiment, the color of the developing cartridge 4 which can be accommodated in each of the accommodating spaces 15*y*, 15*m*, 15*c* and 15*k* of the developing rotary unit 3. Specifically, the developing cartridge 4 for yellow or black is mountable in the accommodating space 15*y*. The developing cartridge 4 for magenta or black is mountable in the accommodating space 15*m*. The developing cartridge 4 for cyan or black is mountable in the accommodating space 15*c*. The developing cartridge 4 for black is mountable in the accommodating space 15*k*.

For example, in the case where the developing cartridge for magenta or cyan is mounted and "Y=3" or "Y=4" is recognized, a user is notified of "abnormal mounting of DC" on a display panel of the image forming apparatus, so that the image forming operation is forbidden.

Also with respect to the accommodating spaces 15*m*, 15*c* and 15*k*, in a similar manner, the color information of the mounted developing cartridge 4 is written in "M", "C" and "K" in the main assembly memory 20.

The CPU 18 confirms whether or not the pieces of the color information of the developing cartridges 4 held in the main assembly memory 20 satisfy "K=1, Y=2, M=3 and C=4" at the same time. In the case where thus condition is confirmed, the developing cartridges 4 accommodating the toners of yellow (Y), magenta (M), cyan (C) and black (K) are judged as being mounted in the accommodating spaces 15*y*, 15*m*, 15*c* and 15*k*, respectively. Then, the CPU 18 selects and executes the image formation control during formation of the full-color image.

When the pieces of the color information of the developing cartridges 4 are not those for forming the full-color image, start of the image forming operation is permitted only in the case where the monochromatic (single color) image is formed.

In the present invention, when the image forming apparatus is used as a monochromatic image-dedicated machine, an occurrence of inconveniences is suppressed by optimizing selection of the developing cartridges (for black) to be used. Hereinafter, when the image forming apparatus is used as the monochromatic image-dedicated machine, a determining method of the developing cartridge 4 to be used for the image formation will be described. In the following description, the developing cartridge determining method in the case where the developing cartridges 4 for the same color (black in this embodiment) are mounted in the accommodating spaces 15*y*, 15*m*, 15*c* and 15*k* will be described.

As a mode for determining the developing cartridge 4 to be used for the image formation, there are two types of modes consisting of a mode A and a mode B. Whether which developing cartridge 4 is to be used in which mode of A and B is automatically determined depending on a status of the remaining toner amount (remaining developer amount) of each of the developing cartridges 4 mounted in the accommodating space 15*y*, 15*m*, 15*c* and 15*k*. In each mode, the determining method of the developing cartridge 4 to be used and a purpose of the mode will be described.

The mode A is applied in the case where one or more developing cartridges 4 with the remaining toner amount of not less than 25% are mounted. The purpose of the mode A is to uniformize a degree of lowering in image quality by a printing operation using the mounted developing cartridge 4, thus preventing the occurrence (presence) of the developing cartridge 4 providing an extremely low image quality. When two developing cartridges 4 with the same remaining toner amount are compared, the developing cartridge 4 with a low average print ratio provides a larger print number than the developing cartridge 4 with a large average print ratio. For that reason, the degree of the image quality lowering by friction among the toner, the toner regulating member 12 and the supplying roller 11 becomes large. When the average print ratio is extremely low, the image quality provided by the developing cartridge 4 is remarkably lowered. In order to prevent the occurrence of the developing cartridge 4 providing the extremely low image quality, the developing cartridge 4 is selected and used so that an overall average print ratio from the initial use of each of the developing cartridges 4 in the same value.

When an image forming (job is requested from a personal computer 22, inputted image data is converted into a video signal consisting of a dot image and at that time, a print ratio of a print image is calculated. The print image print ratio can be obtained as data calculated by dividing a pixel count of the print image by the number of all of pixels of the print image.

Then, the average print ratios of the respective developing cartridges 4 written in the main assembly memory 20 are checked, and from the developing cartridges 4, the developing cartridge 4 with a largest difference between the average print ratio and the print image print ratio is selected and subjected to the image forming operation.

For example, in a state of Table 1 shown below in which the developing cartridges 4 mounted in the image forming apparatus are placed, the print image print ratio is assumed to be 10%. In this case, the largest difference between the average print ratio and the print image print ratio is obtained in the accommodating space 15*k* with the average print ratio of 3%, so that the developing cartridge 4 mounted in the accommodating space 15*k* is used.

On the other hand, in the case where the print image print ratio is 1%, the largest difference between the average print ratio and the print image print ratio is obtained in the accommodating space 15*m* with the average print ratio of 8%, so that the developing cartridge 4 mounted in the accommodating space 15*m* is used.

TABLE 1

| AS *1 | APR *2 (%) | PN *3 (sheets) |
|---|---|---|
| 15y | 4 | 1000 |
| 15m | 8 | 50 |
| 15c | 5 | 200 |
| 15k | 3 | 400 |

*1: "AS" represents the accommodating space.
*2: "APR" represents the average print ratio.
*3: "PN" represents the print number.

In this way, by selecting the developing cartridge 4 to be subjected to the image formation, the developing cartridges 4 mounted in the developing rotary unit 3 can be averaged.

Next, the mode B will be described. The mode B is automatically applied in the case where all of the developing cartridges 4 mounted in the developing rotary unit 3 are less than 25% (in remaining toner amount). In the mode B, as the developing cartridge 4 to be subjected to the image formation, the developing cartridge 4 with a smallest remaining toner amount is selected. When the mode A is selected in the state in which all of the developing cartridges 4 mounted in the developing rotary unit 3 are less than 25%, there arises a situation that all of the plurality of developing cartridges 4 run out substantially at the same time.

In the case where all of the developing cartridges 4 mounted in the developing rotary unit 3 are less than 25%, by automatically changing the mode to the mode B, it is possible to obviate the situation.

Further, in the case where the plurality of developing cartridges 4 are selected in the mode A and the mode B, from the selected developing cartridges 4, the developing cartridge 4 with a shortest distance to move to the position in which the image formation is effected (the position of the accommodating space 15*y* in FIG. 1) is selected.

Figure 4:
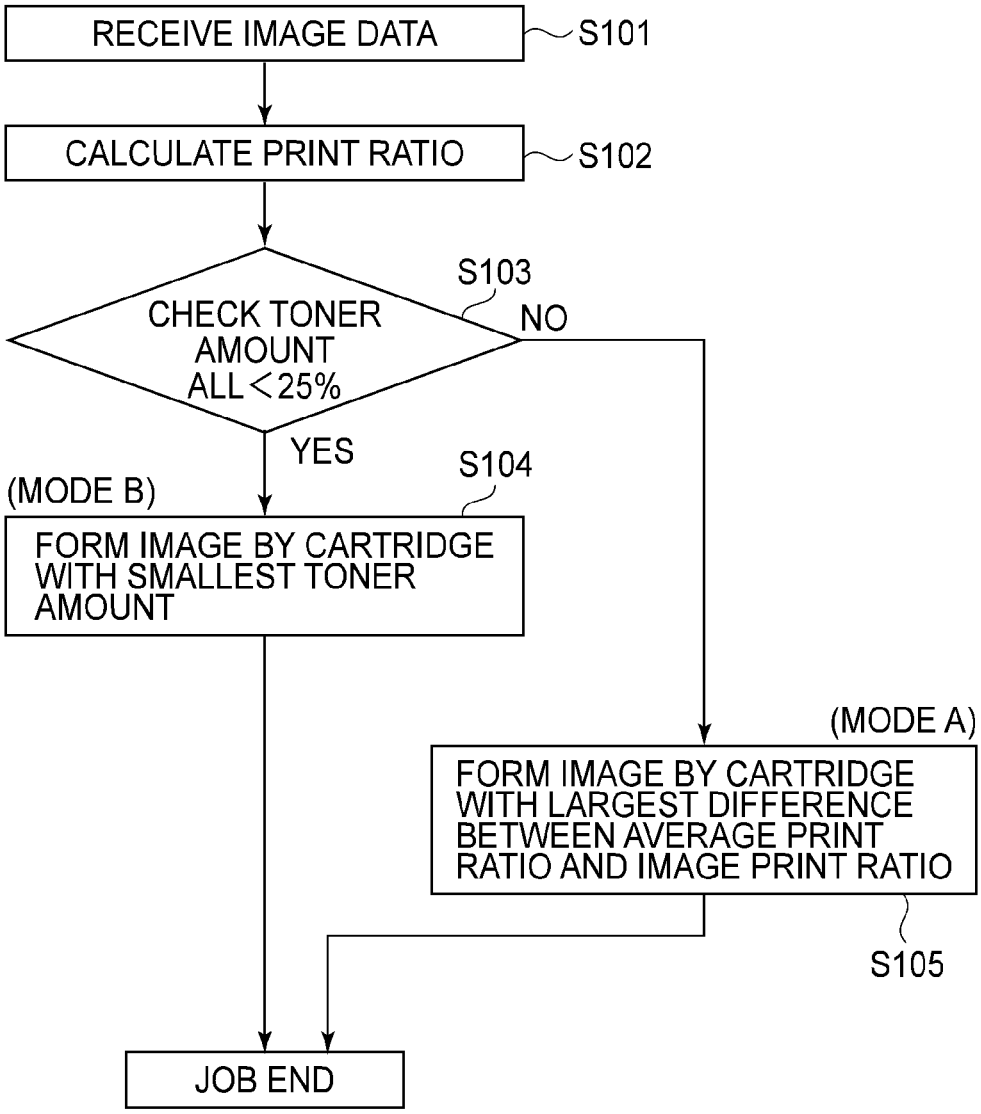
FIG. 4 is a flow chart for illustrating an operation of the image forming apparatus in Embodiment 1.

Next, the operation when the developing cartridges 4 are used in the monochromatic image-dedicated machine will be described by using a flow chart of FIG. 4.

From the personal computer 22, the image data is received (S101). When the image data is received, the image data is converted into the video signal consisting of the dot image by the video controller 17 shown in FIG. 3, so that the print image print ratio is calculated (S102).

The main assembly controller 16 calls up the remaining toner amounts of the developing cartridges 4 mounted in the developing rotary unit 3 from the main assembly memory 20 (S103).

At this time, in the case where all of the remaining toner amounts of the developing cartridges 4 are less than 25%, the developing cartridge 4 with the smallest remaining toner amount is moved to the position in which the developing cartridge 4 opposes the photosensitive drum 2, and is subjected to the image formation (mode B) (S104). On the other hand, in the case where at least one of the developing cartridges 4 with the remaining toner amount of not less than 25% is mounted, the controller 16 calls up the average print ratio of the developing cartridge 4 from the main assembly memory 20 to calculate the difference between the average print ratio and the print ratio of the image data. The developing cartridge 4 with the largest absolute value of the difference which has been calculated (computed) is moved to the developing position, and then the image forming operation is performed (mode A) (S105).

As described above, when the image forming apparatus is used as the monochromatic image-dedicated machine, it becomes possible to uniformize the degree of the lowering in image quality by employing the mode A in the case where at least one of the developing cartridges 4 with the remaining toner amount of not less than 25%. By changing the mode to the mode B with timing when the remaining toner amounts of all of the developing cartridges 4 are less than 25%, it becomes possible to obviate the status that all of the developing cartridges 4 run out substantially at the same time.

Incidentally, in this embodiment, the description is made with respect to the case where the four developing cartridges 4 for black are mounted but similar control is effected also in the case where two or three developing cartridges 4 for black are mounted.

In this embodiment, in order to uniformize the degree of the image quality lowering with respect to each of the developing cartridges 4, the developing cartridge 4 is determined by using the average print ratio but the present invention is not limited thereto. The value for determining the developing cartridge 4 may be a numerical value which is an index of toner deterioration.

(Modified Embodiment 1 of Embodiment 1)

For example, there is a case where the user wishes to consider toner deterioration in a driving time of the developing cartridge 4, not only during the image formation but also before and after the image formation, such as the toner deterioration by the rotation of the developing roller 10. In that case, the degree of the image quality lowering may be uniformized by an index calculated by using, as parameters, an integrated value of the number of dots from the initial use and the developing roller rotation number (i.e., an integral value of the number of rotations of the developing roller from the initial use).

When an image forming (job is requested from a personal computer 22, inputted image data is converted into a video signal consisting of a dot image and at that time, "(dot number of print image)/(developing roller rotation number (i.e., rotation number of developing roller 10 necessary to form print image)" is calculated.

Then, the values of "integrated value of dot number from initial use)/(developing roller rotation number)" written in the main assembly memory 20 are checked, and from the developing cartridges 4, the developing cartridge 4 with a largest difference between "(integrated value of dot number from initial use)/(developing roller rotation number)" and the "(dot number of print image)/(developing roller rotation number)" is selected and subjected to the image formation. For example, the case where an image with the print image print ratio of about 5% is printed in a state of Table 2 shown below in which the developing cartridges 4 mounted in the image forming apparatus are placed will be described. This image provides a predetermined value of "(dot number of print image)/(developing roller rotation number)", e.g., 3100.

Here, the developing cartridge 4 with the largest difference between the "(dot number of print image)/(developing roller rotation number)" (e.g., 3100) and the "(integrated value of dot number from initial use)/(developing roller rotation number)" is that accommodated in the accommodating space 15*k*, so that the developing cartridge 4 accommodated in the accommodating space 15*k* is used. In this modified embodiment, the toner deterioration by the rotation of the developing roller 10 before and after the image formation is also taken into consideration and therefore it becomes possible to accurately grasp the toner deterioration in the developing cartridge 4.

TABLE 2

| AS *1 | (DNIU)/(DRRN) *2 |
|---|---|
| 15y | 3000 |
| 15m | 2650 |
| 15c | 1500 |
| 15k | 5100 |

*1: "AS" represents the accommodating space.

*2: "(DNIU)/(DRRN)" represents "(integral value of dot number from initial use)/(developing roller rotation number).

Figure 5:
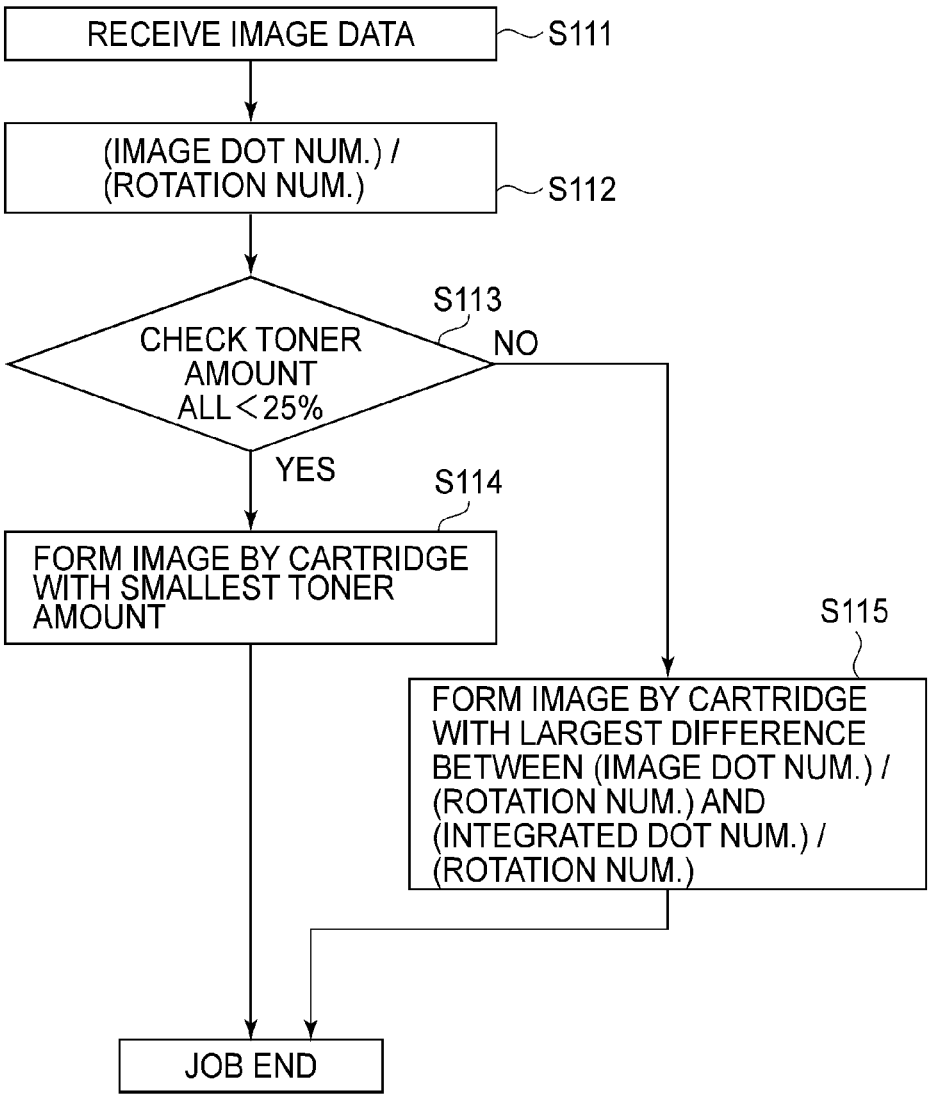
FIG. 5 is a flow chart for illustrating an operation of the image forming apparatus in Modified Embodiment 1 of Embodiment 1.

Next, the operation in this modified embodiment will be described by using a flow chart of FIG. 5. The operation is the same as in the case of that in Embodiment 1 shown in the flow chart of FIG. 4 but in this modified embodiment, steps S112 and S115 are different from the steps S102 and S105 in Embodiment 1.

That is, from the personal computer 22, the image data is received (S111). When the image data is received, different from the step S102, in place of the print image print ratio, the "(dot number of print image)/(developing roller rotation number)" is calculated (S112).

Then, similarly as in Embodiment 1, the main assembly controller 16 calls up the remaining toner amounts of the developing cartridges 4 mounted in the developing rotary unit 3 from the main assembly memory 20 (S113).

At this time, in the case where all of the remaining toner amounts of the developing cartridges 4 are less than 25%, the developing cartridge 4 with the smallest remaining toner amount is moved to the position in which the developing cartridge 4 opposes the photosensitive drum 2, and is subjected to the image formation (S114). On the other hand, in the case where at least one of the developing cartridges 4 with the remaining toner amount of not less than 25% is mounted, the controller 16 calls up the "(dot number of print image)/(developing roller rotation number)" from the main assembly memory 20 to calculate the difference between the "(dot number of print image)/(print ratio rotation number)" and the "(integrated value of dot number from initial use)/(developing roller rotation number)". The developing cartridge 4 with the largest absolute value of the difference which has been calculated (computed) is moved to the position in which the developing cartridge 4 opposes the photosensitive drum 2 (developing position), and then the image forming operation is performed (S115).

Incidentally, in Modified Embodiment of Embodiment 1, as the index of the toner deterioration by the driving time of the developing cartridge 4, i.e., by the rotation of the developing roller 10, the "developing roller rotation number" is employed but it is also possible to employ a "developing roller rotation time" in place of the "developing roller rotation number".

(Modified Embodiment 2 of Embodiment 1)

In Embodiment 1, the determined mode for the developing cartridge 4 used for the image formation is constituted so as to be automatically switched but may also be constituted so that the user can manually select the mode to be used from the mode A and the mode B.

In this case, when the user wishes to always uniformize the degree of the image quality lowering of the developing cartridge 4, the user can manually select the mode A, so that the constitution in this modified embodiment can further meet the user needs.

Figure 6:
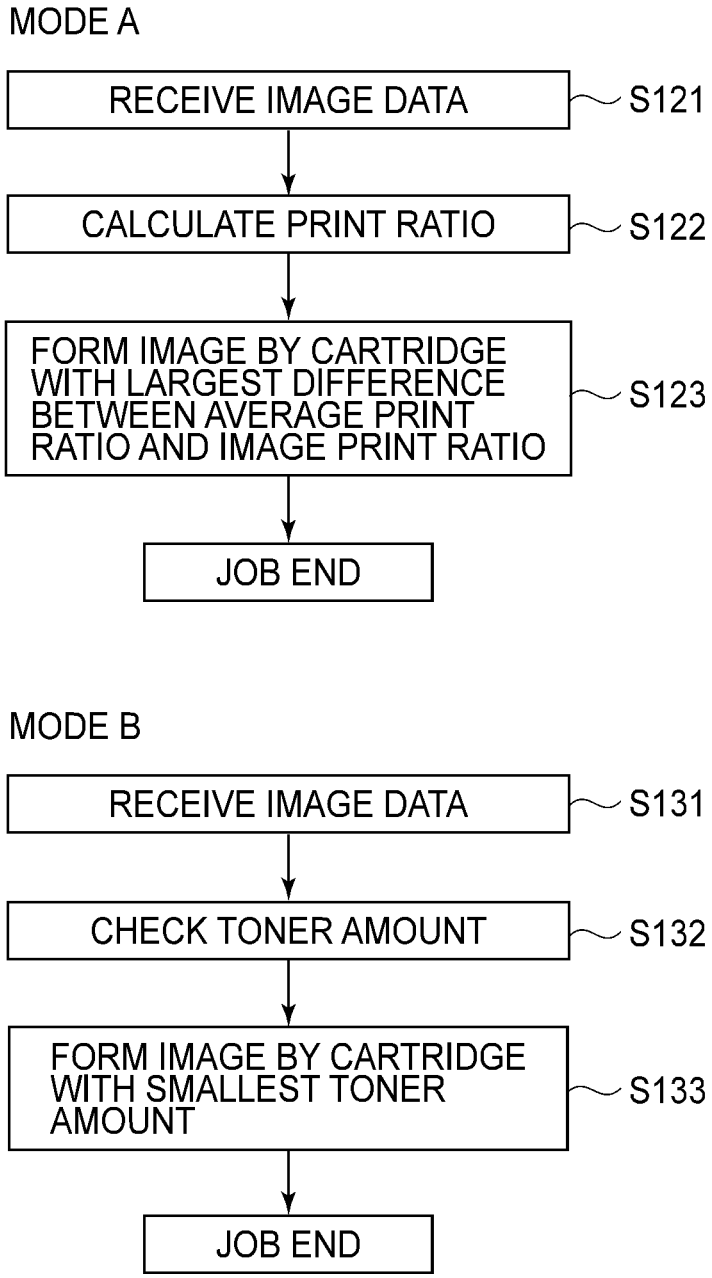
FIG. 6 includes flow charts for illustrating an operation of the image forming apparatus in Modified Embodiment 2 of Embodiment 1.

FIG. 6 shows a flow chart in the case where the mode 4 A is selected manually.

In this modified embodiment, the image data is received from the personal computer 22 (S121). When the image data is received, the print image print ratio is calculated (S122).

In the case where the mode A is selected manually, the remaining toner amount is not used and therefore the controller calls up the average print ratio of the developing cartridge 4 from the main assembly memory to calculate the difference between the average print ratio and the print ratio of the image data. The developing cartridge 4 with the largest absolute value of the difference which has been calculated is moved to the developing position, and then the image forming operation is performed (S123).

In the case where the mode B is selected, in FIG. 6, the image data is received from the personal computer 22 (S131).

The main assembly controller 16 calls up, without calculating the print ratio of the image data, the remaining toner amounts of the developing cartridges 4 mounted in the developing rotary unit 3 from the main assembly memory 20 to check the remaining toner amounts of the developing cartridges 4 (S132).

The developing cartridge 4 with the smallest remaining toner amount is moved to the position in which the developing cartridge 4 opposes the photosensitive drum 2 (developing position), and then the image forming operation is performed (S133).

(Modified Embodiment 3 of Embodiment 1)

In Embodiment 1, the mode to be used is changed depending on the remaining toner amount as the lifetime information of the developing cartridge 4 but may also be changed depending on another lifetime information of the developing cartridge 4. The lifetime information of the developing cartridge 4 will be described.

The timing of provision of notification of the end of the lifetime of the developing cartridge 4 is either one of the time when the developing cartridge 4 reaches its end with respect to the remaining toner amount and the time when the developing cartridge 4 reaches its end with respect to the driving time thereof from the initial use (e.g., the developing roller rotation number (driving time)).

For example, the image with the low print ratio is printed on a large number of sheets, an opportunity of friction between the developing roller 10 and the photosensitive drum 2 is increased and thus hard wearing of the developing roller 10 occurs, so that the developing cartridge 4 is required to be exchanged, although a sufficient amount of the toner is present, after the developing roller rotation number from the initial use reaches a predetermined rotation number, e.g., after 10,000 rotations of the developing roller 10.

For that reason, even when the remaining toner amount is sufficient, at the time when the developing roller rotation number from the initial use reaches 10,000 rotations, the notification of the end of the lifetime of the developing cartridge 4 is provided. For that reason, the remaining lifetime of the developing roller 10, i.e., the remaining lifetime of the developing roller 4 can be represented by (developing roller rotation number from initial use)/10,000 rotations. The developing roller remaining lifetime is defined by a smaller one of the remaining toner amount and the remaining lifetime of the developing roller 10.

For example, in the case where the remaining toner amount is 40% and the remaining lifetime of the developing roller 10 is 25%, the developing cartridge remaining lifetime is 25%. In the case where the remaining toner amount is 25% and the remaining lifetime of the developing roller 10 is 60%, the developing cartridge remaining lifetime is 25%.

Next, by using a flow chart of FIG. 7, an operation in this modified embodiment will be described. The operation is the same as that in the case of Embodiment 1 shown in the flow chart of FIG. 4 but is different in that the "remaining toner amount" is changed to the "developing cartridge remaining lifetime" in this modified embodiment.

Figure 7:
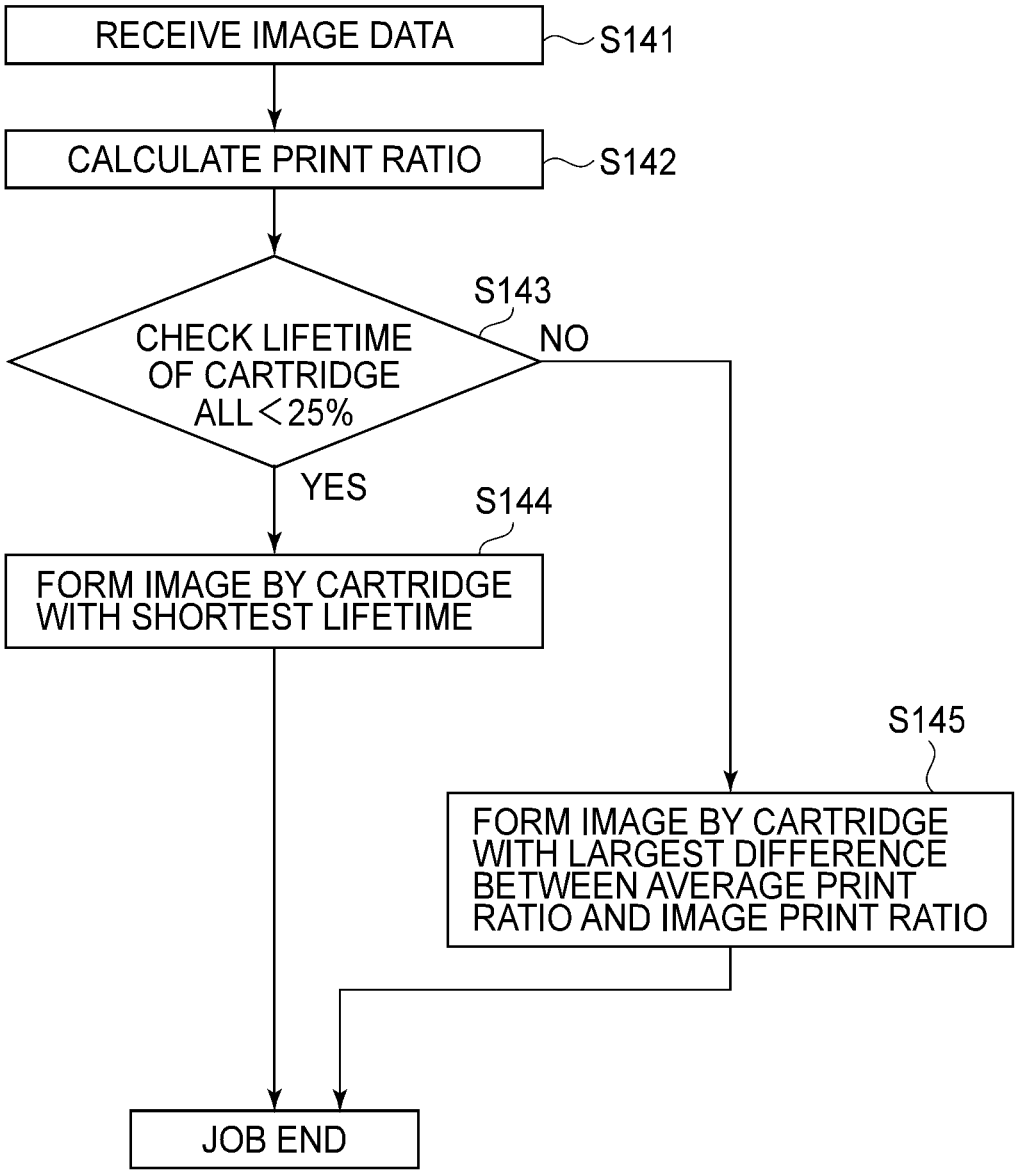
FIG. 7 is a flow chart for illustrating an operation of the image forming apparatus in Modified Embodiment 3 of Embodiment 1.

Referring to FIG. 7, from the personal computer 22, the image data is received (S141). When the image data is received, the image data is converted into the video signal consisting of the dot image by the video controller 17 shown in FIG. 3, so that the print image print ratio is calculated (S142).

The main assembly controller 16 calls up the developing cartridge remaining lifetimes of the developing cartridges 4 mounted in the developing rotary unit 3 from the main assembly memory 20 to check the developing cartridge remaining lifetimes (S143).

At this time, in the case where all of the developing cartridge remaining lifetimes of the developing cartridges 4 are less than 25%, the developing cartridge 4 with the shortest developing cartridge remaining lifetime is moved to the position in which the developing cartridge 4 opposes the photosensitive drum 2, and is subjected to the image formation (S144). On the other hand, in the case where at least one of the developing cartridges 4 with the developing cartridge remaining lifetime of not less than 25% is mounted, the controller 16 calls up the average print ratio of the developing cartridge 4 from the main assembly memory 20 to calculate the difference between the average print ratio and the print ratio of the image data. The developing cartridge 4 with the largest absolute value of the difference which has been calculated (computed) is moved to the position in which the developing cartridge 4 opposes the photosensitive drum 2, and then the image forming operation is performed (S145).

As described above, when the image forming apparatus is used as the monochromatic image-dedicated machine, it becomes possible to uniformize the degree of the lowering in image quality by employing the mode A in the case where at least one of the developing cartridges 4 with the remaining toner amount of not less than 25%. By changing the mode to the mode B with timing when the remaining toner amounts of all of the developing cartridges 4 are less than 25%, it becomes possible to obviate the status that all of the developing cartridges 4 run out substantially at the same time.

In Embodiment 1 and Modified Embodiments 1 to 3 of Embodiment 1 described above, as the remaining toner amount detecting means (remaining developer amount detecting means), the pixel count method in which the remaining toner amount was calculated by the integrated value of laser light emission time from the initial use (integrated pixel count) was employed. That is, in these embodiments, the pixel count method in which the remaining developer amount was detected by counting the number of pixels at a portion where the developer for the latent image to be formed on the photosensitive drum 2 was transferred was used. However, the present invention is not limited thereto but may also be employ an electrostatic capacity method or optical remaining toner amount detection.

In Embodiment 1 and Modified Embodiments 1 to 3 of Embodiment 1, the image forming apparatus including the developing rotary unit 3 is used but the present invention is not limited thereto but may also be an image forming apparatus of a tandem type or an image forming apparatus of a 4-cycle type in which the developing cartridges are fixedly disposed.

Embodiment 2

Next, Embodiment 2 (Second Embodiment) of the image forming apparatus according to the present invention will be described. The image forming apparatus in this embodiment is different from the image forming apparatus in Embodiment 1 in that three types of the determining methods for determining the developing cartridge 4 to be used are employed in this embodiment. Therefore, with respect to the description of the general structure and function of the image forming apparatus, the description made in Embodiment 1 will be quoted. Similarly as in Embodiment 1, the case where the four developing cartridges 4 for black are mounted in the developing rotary unit 3 will be described.

In this embodiment, as a mode for determining the developing cartridge 4 to be used for the image formation, there are two types of modes consisting of the mode A, the mode B and a mode C. Whether which developing cartridge 4 is to be used in which mode of A, B and C is automatically determined depending on a status of the remaining toner amount of each of the developing cartridges 4 mounted in the developing rotary unit 3 and on setting of a printer driver described later. In each mode, the determining method of the developing cartridge 4 to be used and a purpose of the mode will be described.

The determining method of the developing cartridge 4 to be used in the mode A is the same as that in Embodiment 1. Only timing when the mode A is applied is different. The determining method is the same as that in Embodiment 1 and thus will be omitted from the description.

The mode B is applied in order to prevent all of the developing cartridges 4 from running out at the same time. The determining method of the developing cartridge 4 to be used and the timing when the mode B is applied are the same as those in Embodiment 1 and thus will be omitted from the description.

In the mode C, the developing cartridge 4 to be used is determined by an image quality mode designated from the personal computer 22 and the state of the remaining toner amounts of the developing cartridges 4 mounted in the developing rotary unit 3.

In the image forming apparatus in this embodiment, in the personal computer 22, the image quality mode is selected on a screen by a so-called printer driver. The printer driver can select a high-image quality mode and a low-image quality mode.

The high-image quality mode is assumed to be selected during the printing of a photographic image, and a half-tone table, obtained by dithering, with a larger line number than that in the low-image quality mode is used. The image forming apparatus in this embodiment includes an image quality selecting means (selecting portion) 24 (FIG. 3) for selecting the image quality mode. The image quality mode can also be set by a panel operating portion 200 mounted on the image forming apparatus main assembly 100A.

A purpose of the mode C is, when the user selects the high-image quality mode, to provide a high-quality print image by selecting the developing cartridge 4 with least degree of the image quality lowering by the printing operation, from the developing cartridges 4 mounted in the developing rotary unit 3. In the determining method of the developing cartridge 4 in the mode C, the developing cartridge 4 with the largest remaining toner amount is selected when the user selects the high-image quality mode, and is subjected to the image formation.

Next, a switching timing of the respective modes will be described. The mode selecting method is determined depending on the status of the remaining toner amounts of the mounted developing cartridges 4 and on the image quality mode selected by the user.

(I) Case where all of Developing Cartridges 4 Mounted in Developing Rotary Unit are Less than 25% (in Remaining Toner Amount)

In this case, the mode B is automatically applied. In the mode B, by selecting the developing cartridge 4 with the smallest remaining toner amount as the developing cartridge 4 to be used, it is possible to obviate the status in which all of the developing cartridges 4 run out substantially at the same time. Even in the case where the high-image quality mode is selected, all of the developing cartridges 4 are lowered in image quality to the same extent and therefore the mode B is selected.

(II) Case where all of Developing Cartridges 4 Mounted in Developing Rotary Unit are not Less than 50%

In this case, the degree of the image quality lowering by the printing operation using the developing cartridges 4 mounted in the developing rotary unit 3 is small. For that reason, even in the case where the user selects the high-image quality mode, there is of no problem in terms of quality even when any developing cartridge 4 is used, and thus the developing cartridge 4 is selected in the mode A.

(III) Case Other than (I) and (II)

In this case, the degree of the image quality lowering by the printing operation using the developing cartridges 4 mounted in the developing rotary unit 3 is different every developing cartridge 4 and is larger with an decreasing remaining toner amount.

For that reason, when the user selects the high-image quality mode, the developing cartridge 4 with the largest remaining toner amount is selected. On the other hand, when the user selects the low-image quality mode, the developing cartridge 4 is selected in the mode A and is used so that the average print ratio becomes uniform.

Figure 8:
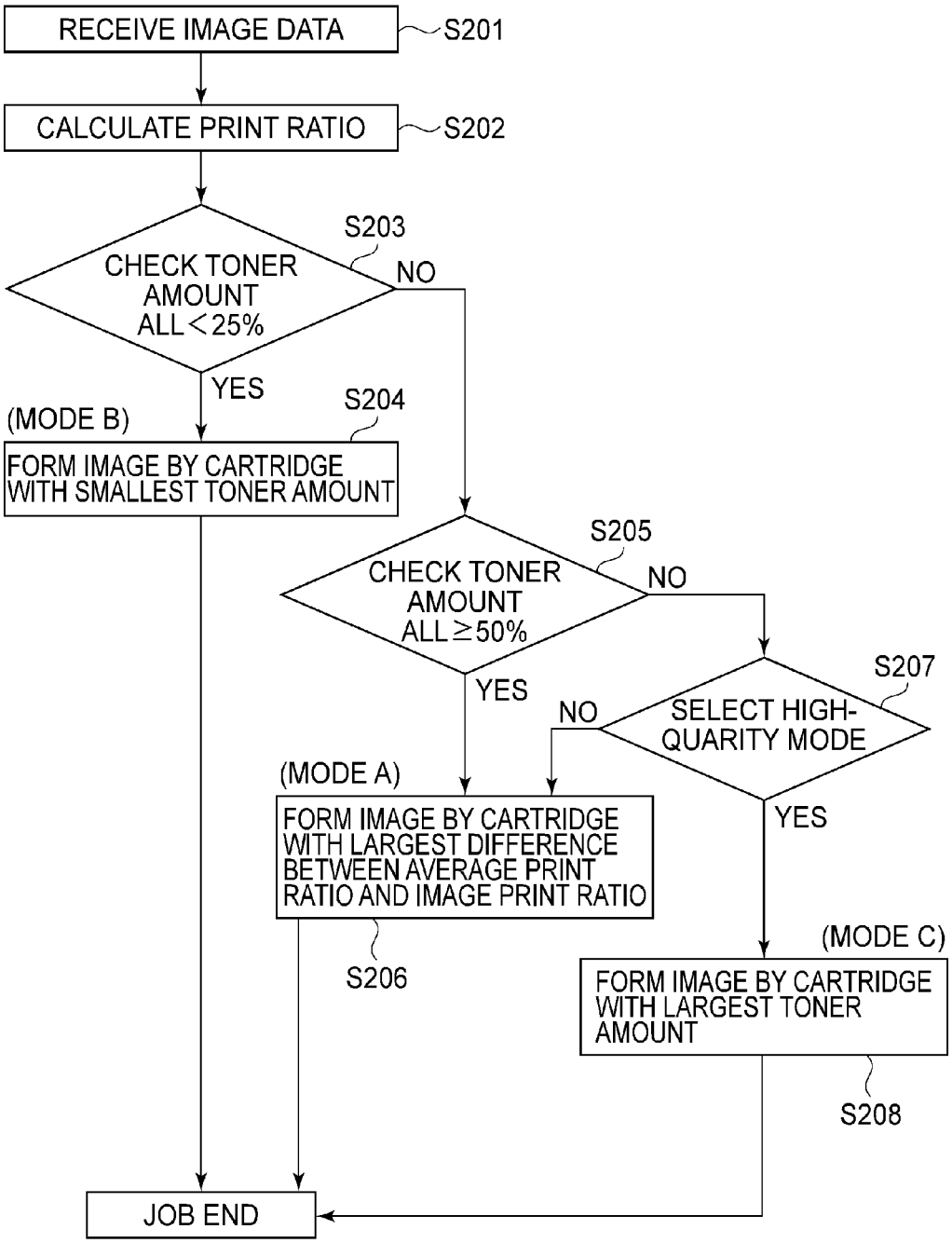
FIG. 8 is a flow chart for illustrating an operation of the image forming apparatus in Embodiment 2.

Next, the operation when the developing cartridges 4 are used in the monochromatic image-dedicated machine will be described by using a flow chart of FIG. 8.

From the personal computer 22, the image data is received (S201). When the image data is received, the image data is converted into the video signal consisting of the dot image by the video controller 17, so that the print image print ratio is calculated (S202).

The main assembly controller 16 calls up the remaining toner amounts of the developing cartridges 4 mounted in the developing rotary unit 3 from the main assembly memory 20 (S203).

At this time, in the case where all of the remaining toner amounts of the developing cartridges 4 are less than 25%, the developing cartridge 4 with the smallest remaining toner amount is moved to the position in which the developing cartridge 4 opposes the photosensitive drum 2, and is subjected to the image formation (S204). On the other hand, in the case where at least one of the developing cartridges 4 with the remaining toner amount of not less than 25% is mounted, the controller 16 checks, from the main assembly memory 20, whether or not all of the developing cartridges 4 have the remaining toner amounts of not less than 50% (S205). Further, in the case where all of the mounted developing cartridges 4 have the remaining toner amounts of not less than 50%, the controller 16 calls up the average print ratio of the developing cartridge 4 from the main assembly memory 20 to calculate the difference between the average print ratio and the print ratio of the image data. The developing cartridge 4 with the largest absolute value of the difference which has been calculated (computed) is moved to the position in which the developing cartridge 4 opposes the photosensitive drum 2, and then the image forming operation is performed (S206).

On the other hand, in the case where there are the developing cartridges 4 with the remaining toner amount of less than 50% and in the case of the low-image quality mode, the developing cartridge 4 with the largest difference between the average print ratio and the print ratio of the image data is selected and is subjected to the image formation (S207 and S206). Further, in the case of the high-image quality mode, the developing cartridge 4 with the largest remaining toner amount is selected and is subjected to the image formation (S207 and S208).

As described above, when the image forming apparatus is used as the monochromatic image-dedicated machine, it becomes possible to uniformize the degree of the lowering in image quality by employing the mode A. By changing the mode to the mode B, it becomes possible to obviate the status that all of the developing cartridges 4 run out substantially at the same time, so that it becomes possible to provide a high-quality print image compared with the higher-image quality mode in the mode C.

In Embodiment 2, as the determining mode of the developing cartridge 4, the three modes A, B and C are employed but the present invention is not limited thereto but may also employ four or more mode.

(Modified Embodiment 1 of Embodiment 2)

In Embodiment 2, the determined mode for the developing cartridge 4 used for the image formation is constituted so as to be automatically switched but may also be constituted so that the user can manually select the mode to be used from the mode A, the mode B and the mode C.

In this case, when the user wishes to always uniformize the degree of the image quality lowering of the developing cartridge 4, the user can manually select the mode A, and when the user wishes to effect the printing in the high-image quality mode, the user can manually select the mode C. As a result, the constitution in this modified embodiment can further meet the user needs.

Figure 9:
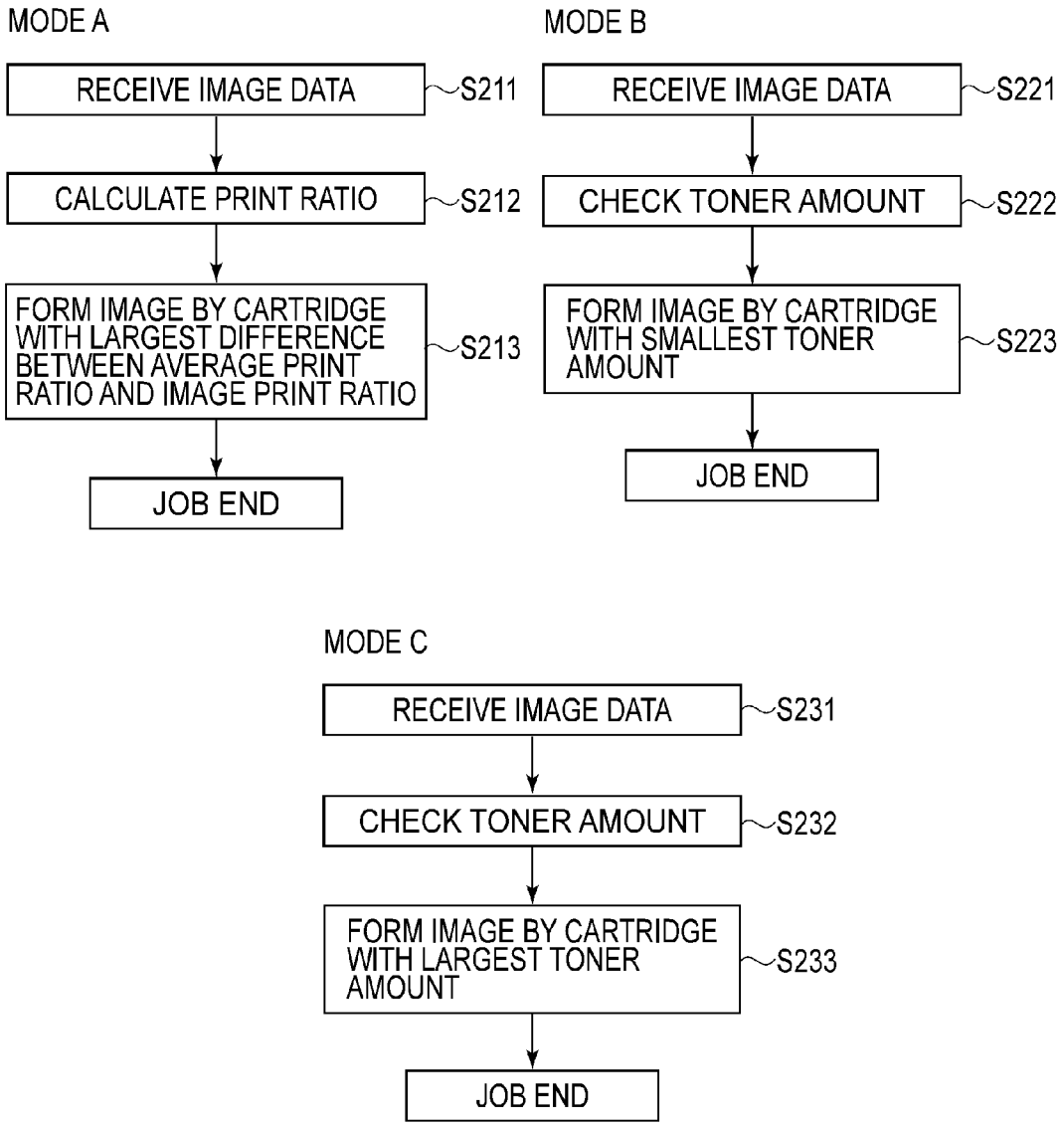
FIG. 9 includes flow charts for illustrating an operation of the image forming apparatus in Modified Embodiment 1 of Embodiment 2.

FIG. 9 shows flow charts the cases where the modes A, B and C are selected manually respectively.

(Case where Mode A is Selected)

The image data is received from the personal computer 22 (S211). When the image data is received, the print image print ratio is calculated (S212).

In the case where the mode A is selected manually, the remaining toner amount is not used and therefore the controller calls up the average print ratio of the developing cartridge 4 from the main assembly memory to calculate the difference between the average print ratio and the print ratio of the image data. The developing cartridge 4 with the largest absolute value of the difference which has been calculated is moved to the position in which the developing cartridge 4 opposes the photosensitive drum 2, and then the image forming operation is performed (S213).

(Case where Mode B is Selected)

The image data is received from the personal computer 22 (S221).

The main assembly controller 16 calls up, without calculating the print ratio of the image data, the remaining toner amounts of the developing cartridges 4 mounted in the developing rotary unit 3 from the main assembly memory 20 to check the remaining toner amounts of the developing cartridges 4 (S222).

The developing cartridge 4 with the smallest remaining toner amount is moved to the position in which the developing cartridge 4 opposes the photosensitive drum 2, and then the image forming operation is performed (S223).

(Case where Mode C is Selected)

Different from the case where the mode B is selected, the developing cartridge 4 which is capable of forming a most beautiful image and has the largest remaining toner amount is selected.

That is, the image data is received from the personal computer 22 (S231).

The main assembly controller 16 calls up, without calculating the print ratio of the image data, the remaining toner amounts of the developing cartridges 4 mounted in the developing rotary unit 3 from the main assembly memory 20 to check the remaining toner amounts of the developing cartridges 4 (S232).

The developing cartridge 4 with the largest remaining toner amount is moved to the position in which the developing cartridge 4 opposes the photosensitive drum 2, and then the image forming operation is performed (S233).

(Modified Embodiment 2 of Embodiment 2)

In Embodiment 2, the mode to be used is changed depending on the remaining toner amount but may also be changed depending on lifetime information or the like of the developing cartridge 4. The lifetime information of the developing cartridge 4 is described in Modified Embodiment 3 of Embodiment 1 and therefore will be omitted from detailed description.

That is, even when the remaining toner amount is sufficient, at the time when the developing roller rotation number from the initial use reaches, e.g., 10,000 rotations, the notification of the end of the lifetime of the developing cartridge 4 is provided. For that reason, the remaining lifetime of the developing roller 10 can be represented by (developing roller rotation number from initial use)/10,000 rotations. The developing roller remaining lifetime is defined by a smaller one of the remaining toner amount and the remaining lifetime of the developing roller 10.

For example, in the case where the remaining toner amount is 40% and the remaining lifetime of the developing roller 10 is 25%, the developing cartridge remaining lifetime is 25%. In the case where the remaining toner amount is 25% and the remaining lifetime of the developing roller 10 is 60%, the developing cartridge remaining lifetime is 25%.

Next, by using a flow chart of FIG. 10, an operation in this modified embodiment will be described. The operation is the same as that in the case of Embodiment 2 shown in the flow chart of FIG. 8 but is different in that the "remaining toner amount" is changed to the "developing cartridge remaining lifetime" in this modified embodiment.

Figure 10:
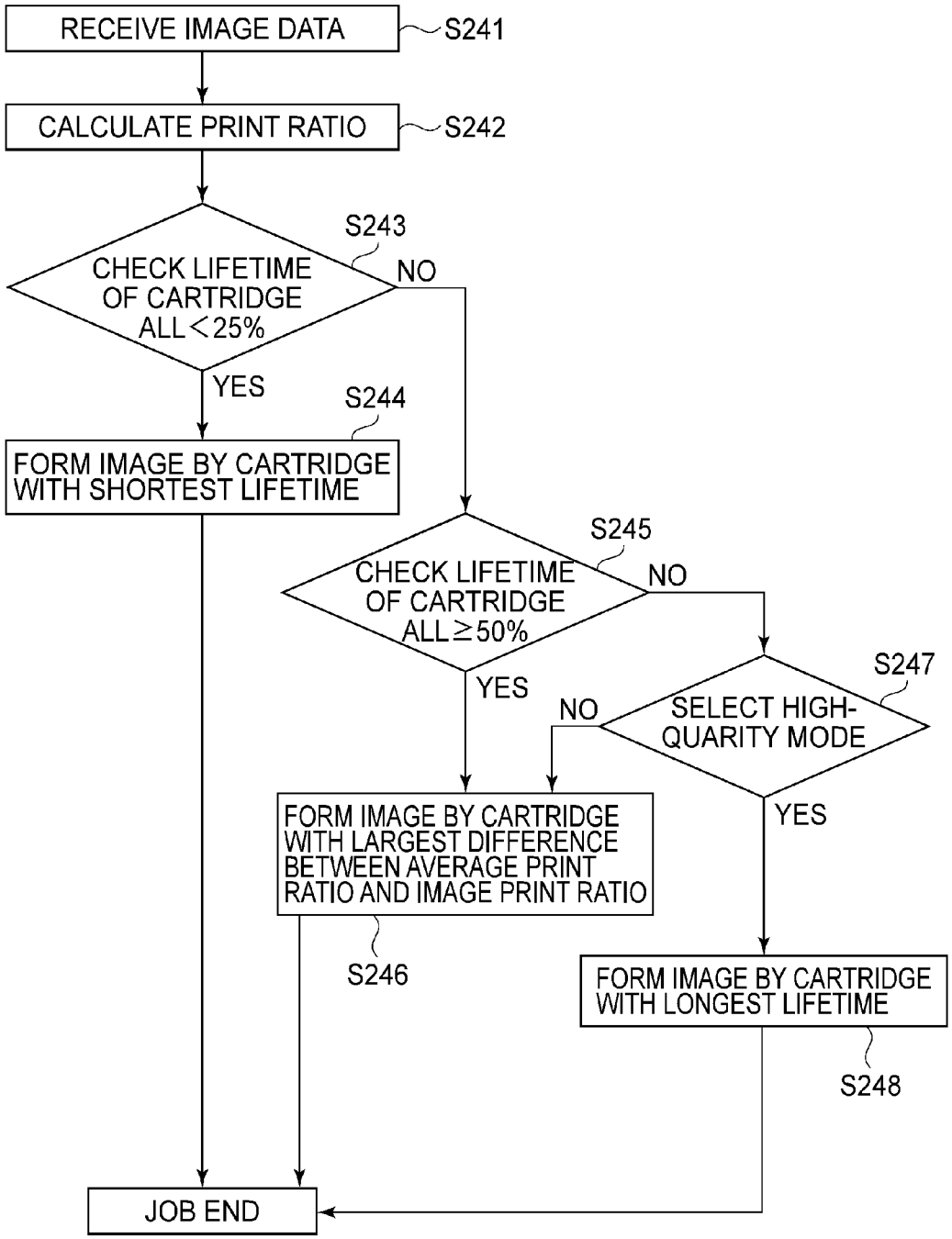
FIG. 10 is a flow chart for illustrating an operation of the image forming apparatus in Modified Embodiment 2 of Embodiment 2.

Referring to FIG. 10, from the personal computer 22, the image data is received (S241). When the image data is received, the image data is converted into the video signal consisting of the dot image by the video controller 17, so that the print image print ratio is calculated (S242).

The main assembly controller 16 calls up the developing cartridge remaining lifetimes of the developing cartridges 4 mounted in the developing rotary unit 3 from the main assembly memory 20 to check the developing cartridge remaining lifetimes (S243).

At this time, in the case where all of the developing cartridge remaining lifetimes of the developing cartridges 4 are less than 25%, the developing cartridge 4 with the shortest developing cartridge remaining lifetime is moved to the position in which the developing cartridge 4 opposes the photosensitive drum 2, and is subjected to the image formation (S244). On the other hand, in the case where at least one of the developing cartridges 4 with the developing cartridge remaining lifetime of not less than 25% is mounted, the controller 16 checks, from the main assembly memory 20, whether or not all of the developing cartridges 4 have the developing cartridge remaining lifetimes of not less than 50% (S245). In the case where all of the developing cartridges 4 with the developing cartridge remaining lifetimes of not less than 50%, the controller 16 calls up the average print ratio of the developing cartridge 4 to calculate the difference between the average print ratio and the print ratio of the image data. The developing cartridge 4 with the largest absolute value of the difference which has been calculated (computed) is moved to the position in which the developing cartridge 4 opposes the photosensitive drum 2, and then the image forming operation is performed (S246).

On the other hand, in the case where there are the developing cartridges 4 with the developing cartridge remaining lifetime of less than 50% and in the case of the low-image quality mode, the developing cartridge 4 with the largest difference between the average print ratio and the print ratio of the image data is selected and is subjected to the image formation (S247 and S246). Further, in the case of the high-image quality mode, the developing cartridge 4 with the largest developing cartridge remaining lifetime is selected and is subjected to the image formation (S247 and S248).

(Modified Embodiment 3 of Embodiment 2)

Further, the image forming apparatus 100 can include an environment detecting means (environment detecting portion) 25 (FIG. 3) for detecting at least one of a temperature, a humidity, absolute water content, and the like as environmental information at a periphery of the image forming apparatus. In this case, when the image quality is lowered depending on the environment, a mode in which the developing cartridge 4 to be used is changed depending on the environment may be provided.

Specifically, in the case where a degree of fog is deteriorated in a high-humidity environment, a mode in which the developing cartridge with long developing cartridge remaining lifetime is selected, when the environmental detecting means 25 detects the high-humidity environment (e.g., a relative humidity of not less than 70%) may be provided. For example, as a result of the detection by the environment detecting means 25, in the case where the relative humidity is not less than 70%, the toner charging property is lowered and the degree of fog is deteriorated. Therefore, in the case where the relative humidity is not less than 70%, the developing cartridge 4 which causes the smallest degree of fog and has the longest developing cartridge remaining lifetime is used.

Next, by using a flow chart of FIG. 11, an operation in this modified embodiment will be described.

Figure 11:
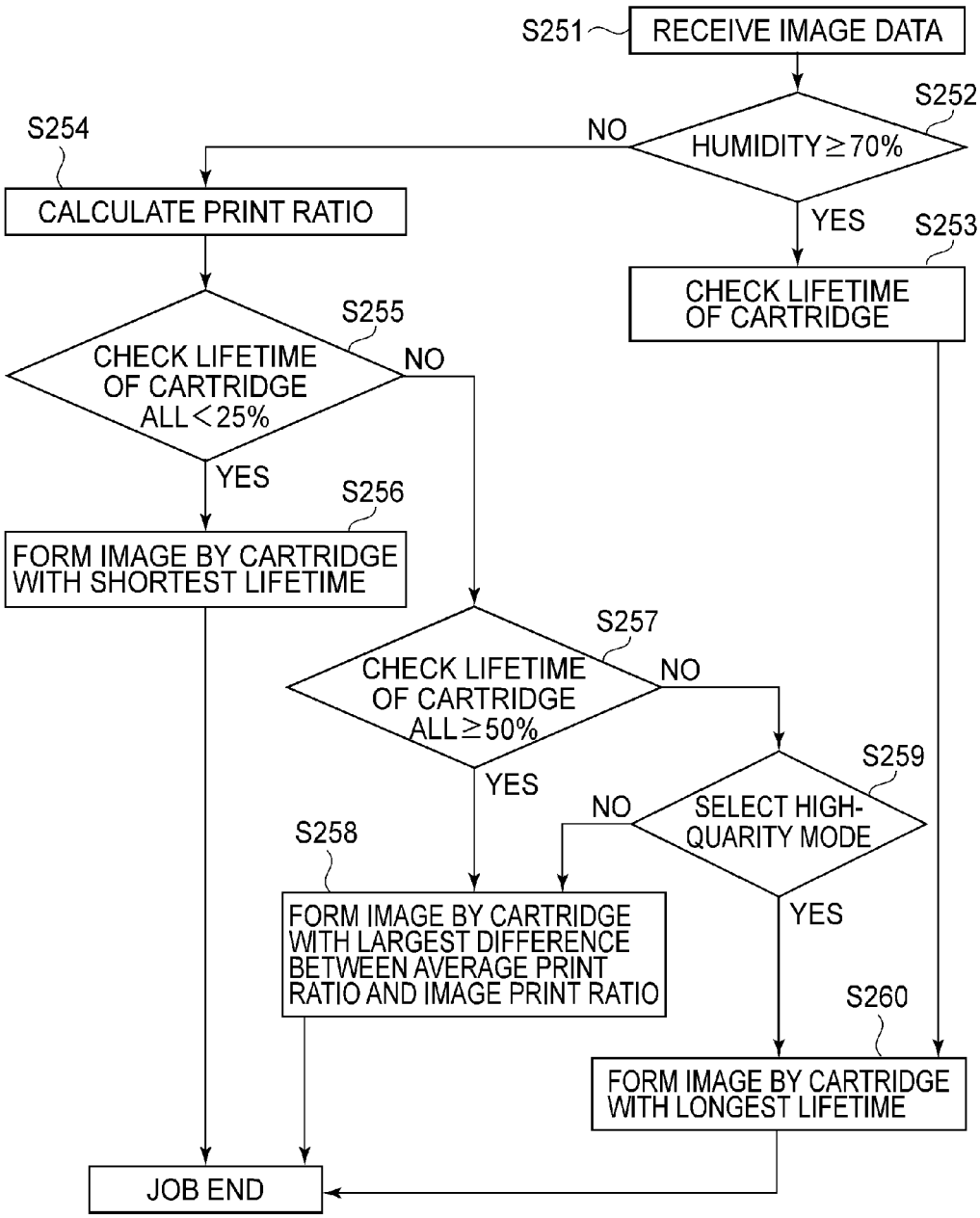
FIG. 11 is a flow chart for illustrating an operation of the image forming apparatus in Modified Embodiment 3 of Embodiment 2.

Referring to FIG. 11, the image data is received from the personal computer 22 (S251). The main assembly controller 16 judges whether or not the environment is the high-humidity environment (e.g., the relative humidity of not less than 70%) (S252). In the case where the environment detecting means 25 detects the high-humidity environment (e.g., the relative humidity of not less than 70%), the main assembly controller 16 calls up and checks, from the main assembly memory 20, the developing cartridge remaining lifetimes of the developing cartridges 4 mounted in the developing rotary unit 3 (S253). Then, the developing cartridge 4 with the longest developing cartridge remaining lifetime is moved to the position in which the developing cartridge 4 opposes the photosensitive drum 2, and then the image formation is effected (S260).

In the step S252, in the case where the environment detecting means 25 does not detect the high-humidity environment (e.g., the relative humidity of not less than 70%), the image data is converted into the video signal consisting of the dot image by the video controller 17, so that the print ratio of the image data is calculated (S254). Subsequent operations (S255 to S260) are similar to the operations (S243 to S248) in the case of Embodiment 2 described with reference to FIG. 10 and therefore will be omitted from the description.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 029126/2010 filed Feb. 12, 2010, which is hereby incorporated by reference.

What is claimed is:

1. An image forming apparatus, to which a plurality of developing cartridges accommodating respective toners are detachably mountable, said apparatus comprising:

a discriminating portion for discriminating color of the toner accommodated in each of said plurality of developing cartridges; and a controller capable of controlling an image forming operation in a state in which developing cartridges, of said plurality of developing cartridges, accommodating toners of the same color are mounted; and wherein, when remaining toner amounts of said developing cartridges accommodating the toners of the same color are respectively less than a predetermined amount, said controller controls the image forming operation so that an image is formed by using a developing cartridge of said developing cartridges accommodating the toners of the same color having the smallest remaining toner amount.

2. An image forming apparatus according to claim 1, further comprising a selecting portion for selecting an image quality mode during the image forming operation, wherein on the basis of the remaining toner amounts and the image quality mode, said controller determines said developing cartridge, of the developing cartridges accommodating the toners of the same color, to be used for performing the image forming operation.

3. An image forming apparatus according to claim 1, further comprising an environment detecting portion for detecting environmental information at a periphery of said image forming apparatus, wherein on the basis of the remaining toner amounts and the environmental information, said controller determines said developing cartridge, of the developing cartridges accommodating the toners of the same color, to be used for performing the image forming operation.

4. An image forming apparatus according to claim 3, further comprising a selecting portion for selecting an image quality mode during the image forming operation, wherein on the basis of the remaining toner amounts, the environmental information, and the image quality mode, said controller determines said developing cartridge, of the developing cartridges accommodating the toners of the same color, to be used for performing the image forming operation.

5. An image forming apparatus according to claim 1, wherein on the basis of the remaining toner amounts, use history information of said developing cartridges, and a print ratio calculated from image data, said controller determines said developing cartridge, of the developing cartridges accommodating the toners of the same color, to be used for performing the image forming operation.

6. An image forming apparatus, to which a plurality of developing cartridges accommodating respective toners are detachably mountable, said image forming apparatus comprising:

a discriminating portion for discriminating color of toner accommodated in each of said plurality of developing cartridges; and a controller capable of controlling an image forming operation in a state in which developing cartridges of said plurality of developing cartridges accommodating the toners of the same color are mounted, wherein, when remaining lifetimes of said developing cartridges accommodating the toners of the same color are respectively less than a predetermined value, said controller controls the image forming operation so that an image is formed by using a developing cartridge, of said plurality of developing cartridges accommodating the toners of the same color, having the shortest remaining lifetime.

7. An image forming apparatus according to claim 6, further comprising a selecting portion for selecting an image quality mode during the image forming operation, wherein on the basis of the remaining lifetimes and the image quality mode, said controller determines said developing cartridge of the developing cartridges accommodating the toners of the same color to be used for performing the image forming operation.

8. An image forming apparatus according to claim 6, further comprising an environment detecting portion for detecting environmental information at a periphery of said image forming apparatus, wherein on the basis of the remaining lifetimes and the environmental information, said controller determines said developing cartridge, of the developing cartridges accommodating the toners of the same color, to be used for performing the image forming operation.

9. An image forming apparatus according to claim 8, further comprising a selecting portion for selecting an image quality mode during the image forming operation, wherein on the basis of the remaining lifetimes, the environmental information, and the image quality mode, said controller determines said developing cartridge, of the developing cartridges accommodating the toners of the same color, to be used for performing the image forming operation.

10. An image forming apparatus according to claim 6, wherein the remaining lifetime is determined on the basis of a remaining toner amount of said developing cartridge and an integrated value of a driving time from initial use of the developing cartridge.

11. An image forming apparatus according to claim 6, wherein on the basis of the remaining lifetimes, use history information of said developing cartridge, and a print ratio calculated from image data, said controller determines said developing cartridge, of the developing cartridges accommodating the toners of the same color, to be used for performing the image forming operation.

12. An image forming apparatus according to claim 1, further comprising a storing portion for storing the remaining toner amounts of said plurality of developing cartridges, respectively.

13. An image forming apparatus according to claim 6, further comprising a storing portion for storing the remaining lifetimes of said plurality of developing cartridges, respectively.

* * * * *